United States Patent [19]

Barbiaux et al.

[11] Patent Number: 5,000,460

[45] Date of Patent: Mar. 19, 1991

[54] GOLF GAME

[76] Inventors: Joseph Barbiaux, 24569 Scott Blvd., Olmsted Falls OH, 44138; Michael Clark, 1459 Winton Ave., Lakewood, Ohio 44107

[21] Appl. No.: 489,466

[22] Filed: Mar. 6, 1990

[51] Int. Cl.[5] ..... A63F 3/00

[52] U.S. Cl. ..... 273/245; 273/240

[58] Field of Search ..... 273/245, 240

[56] References Cited

U.S. PATENT DOCUMENTS

| | | | |
|---|---|---|---|
| 1,758,581 | 5/1930 | Morch | 273/245 |
| 4,134,590 | 1/1979 | Conrad | 273/245 |
| 4,809,985 | 3/1989 | Trimble | 273/245 |

FOREIGN PATENT DOCUMENTS

| | | | |
|---|---|---|---|
| 322221 | 12/1929 | United Kingdom | 273/245 |
| 1334524 | 10/1973 | United Kingdom | 273/245 |
| 2135200 | 8/1984 | United Kingdom | 273/245 |

*Primary Examiner*—Benjamin Layno
*Attorney, Agent, or Firm*—J. Helen Slough

[57] ABSTRACT

A golf game in which a game board is provided having a plurality of fairways simulating a golf course on which to place players decisions relative to club selection and distance and direction of play, the individual fairway distance and directional slots being determined by throw of dice and putts by rolls of specific numbers on several non-directional dice. Sets of cards bearing instructions for penalities are utilized sccording to rolls of certain numbers on numbered die. Other card sets are employed to when a shot lands on greenside traps or trees. Bonus cards are available occasioned by a roll of particular numbered dice and are to be used according to information given on the back of the said cards. A club selector card is provided listing the different clubs giving distances attained by each of the clubs as determined by the roll of combined numbers of a pair of conventional dice. A direction indicator is adapted to be placed on the hole by each player aimed in his desired direction of play and the same is used also to determine where each shot lands after it is hit. Another is provided for making the position where each shot lands. Movable hazards such as water, trees, sand traps, are provided which can be placed on any hole or holes to redesign the hole as shown on the board and as agreed to by the player or players.

4 Claims, 6 Drawing Sheets

Figure 1:
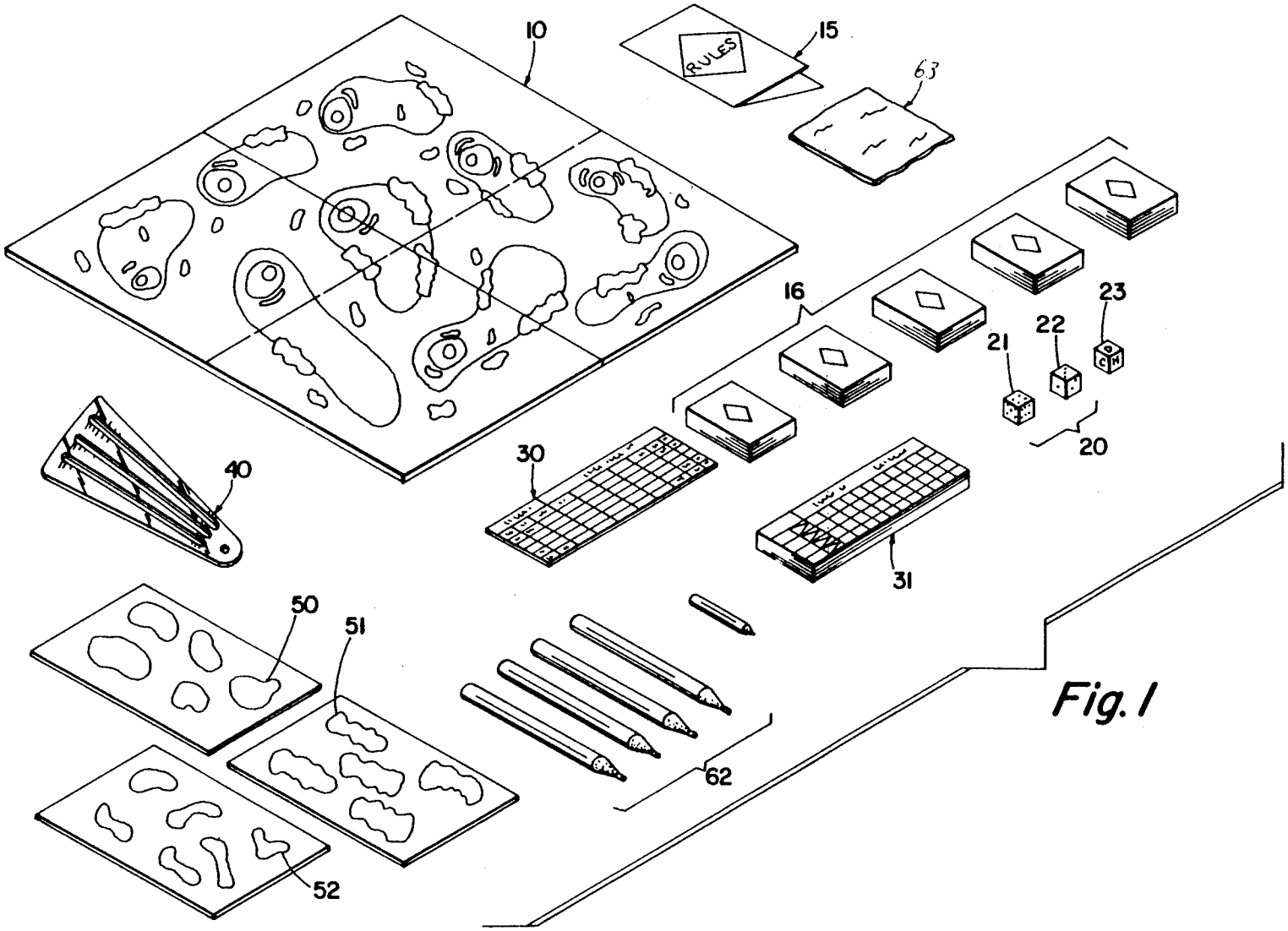

| ROLL | DISTANCE | | | ACCURACY | | | | | | | |
|---|---|---|---|---|---|---|---|---|---|---|---|
| | DRIVER | 3 WOOD | 3 IRON | 4 IRON | 5 IRON | 6 IRON | 7 IRON | 8 IRON | 9 IRON | PITCH WED | SAND WED |
| 12 | 280 | 260 | 240 | 230 | | | | | | 150 | 140 |
| 11 | 270 | 250 | | | | | | | | | 130 |
| 10 | 260 | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| 3 | 180 | | | | | | | | | | 30 |
| 2 | 170 | | | | | | | | 60 | 30 | 20 |
| 1 | 150 | 130 | 120 | | | | | | 50 | 20 | 10 |

30

Fig. 5

Fig. 6

COUNTRY CLUB GOLF

31

| PLAYERS | HOLE | 1 | 2 | 3 | 4 | 5 | 6 | 7 | 8 | 9 | out | 10 | 11 | 12 | 13 | 14 | 15 | 16 | 17 | 18 | In | TOTAL |
|---|---|---|---|---|---|---|---|---|---|---|---|---|---|---|---|---|---|---|---|---|---|---|
| | PAR | 4 | 5 | 3 | 4 | 4 | 4 | 4 | 5 | 3 | | 4 | 3 | 4 | 4 | 4 | 5 | 3 | 4 | 5 | | |
| | | | | | | | | | | | | | | | | | | | | | | |
| | | | | | | | | | | | | | | | | | | | | | | |
| | | | | | | | | | | | | | | | | | | | | | | |
| | | | | | | | | | | | | | | | | | | | | | | |

60
GREENSIDE
TRAP
GREENSIDE
FAIRWAY
TRAP
FAIRWAY
TREES
PENALTY
BONUS
64
64
63
62
61

60
TAKE YOUR BEST SHOT! (SAND WEDGE)
YOU HIT IT THIN! ADD 40 YARDS TO YOUR SHOT.
LOW BRANCHES! USE A 6 IRON OR LESS.
YOU LOST YOUR BALL! 1 STROKE PENALTY.
FREE MULLIGAN!
65
64
63
62
61

GOLF GAME

BACKGROUND OF THE INVENTION

This invention relates to a board game and is particularly adapted to a board-type golf game where holes in a golf course are displayed on a board or boards. Play is begun and carried on by chance selection by the players for the order of play or particular play, arbitrary selection being made by the player or various golf clubs for all fairway, fairway trap, greenside trap, and other hazard shots.

FIELD OF THE INVENTION

In the past various board-type golf games have been the subject of U.S. Letters Patent, for example, U.S. Pat. No. 3,944,229 and have involved use of dice, selection of various clubs for different shots and employment of the same on a pictured course duplicating playing conditions.

U.S. Pat. No. 4,380,338 displays verbal and various indicia on representatious of golf holes to indicate different types of shots, for example "tee" shots, trap shots, and a die for selecting indicia on the charts and for indicating the moving of markers to positions on the golf course corresponding to said indicia.

Various U.S. Patents for golf games include as well various means for determining wind conditions as U.S. Pat. No. 4,108,442 which utilizes a wind vane to determine wind conditions with which the player copes in play of the course of the board game, and U.S. Pat. No. 3,912,270 which utilizes a "multiple variable probability controller," which controller is used to determine the results of a golf shot being played which controller takes the form of a pair of spinners.

U.S. Pat. No. 3,910,581 also discloses the employment of a spinner card which indicates where the ball has landed on making a stroke.

U.S. Pat. No. 1,605,739 also utilizes a spinner on a play designating chart which determines the position to which a playing piece is to be advanced on the hole of the links being played. Concentric series of play designating indications corresponding to a selected spinner determine the advance of the play. The designation also involves a penalty indicator and substitution of a second spinner for release of penalty. The same also contemplates use of a single spinner.

Various patents for golf games as stated above utilize different colored dice for example, U.S. Pat. No. 3,658,339. Various colored dice are also used for different numbered par holes.

U.S. Pat. No. 1,529,598 utilizes dice having letters thereon indicating the character of a stroke.

Other patents, such as U.S. Pat. No. 1,535,126, utilize packs of cards and the use of a scale to measure distance indicated by playing cards.

U.S. Pat. No. 1,513,941 discloses a representation of a regular golf course with sand traps, bunkers, etc. The hole on the green is circumscribed by three circles outlining zones on the green, each extending around the hole. The number of strokes to "hole out" are determined from a special counter.

SUMMARY OF THE INVENTION

In applicant's invention the roll of the dice determines the order of play, a board contains representations of the links of a golf course with appropriate hazards shown thereon, which links may have additional or different hazards placed thereon, which additional hazards may be selectively attached to or detached from any hole on the course, as desired by the players. Prior to in turn rolling dice, each player designates the club which ne desires to use for his tee shot after placing a direction indicator on the fairway and aligning the indicator with the hole on the green as desired. After placing the direction indicator on the fairway and prior to "Hitting" the ball by "rolling of dice" the player determines the appropriate club which he will employ, selects the same from club selector reference means supplied with the game, which reference means states the total distance which each club can conceivably reach. A roll of dice subsequent thereto establishes the actual distance reached by the player with said club as shown on the reference means. Three dice are employed, two of the same bear conventional die markings to establish the distance achieved, and the third die bears indicia indicating the direction of the shot.

If a ball lands in a hazard, for example, on a tree, or in a sand trap, the player takes an appropriate hazard marked card which directs the player's next shot. The player thereafter again aligns the indicator in a desired direction, selects the club to be used for his subsequent shot and rolls all three die to get the distance and direction of the subsequent shot as aforesaid. Both Bonus and Penalty cards are used in the game and are used upon selected rolls of the dice. The game may be played by a team, partners, or as best ball, match play, singles or partners, or skin game, singles or partners. Means are provided for marking each player's plays on the separate holes.

IN THE DRAWINGS

FIG. 1: is a plan view of a game board incorporating, on a reduced scale, representation of several holes of the links of a golf course and includes a plan view of a rule book, sets of cards, a distance direction gauge, dice, and reference cards, implements such as marking pencils used in the game and added shot schedule cards, and score cards.

Figure 2:
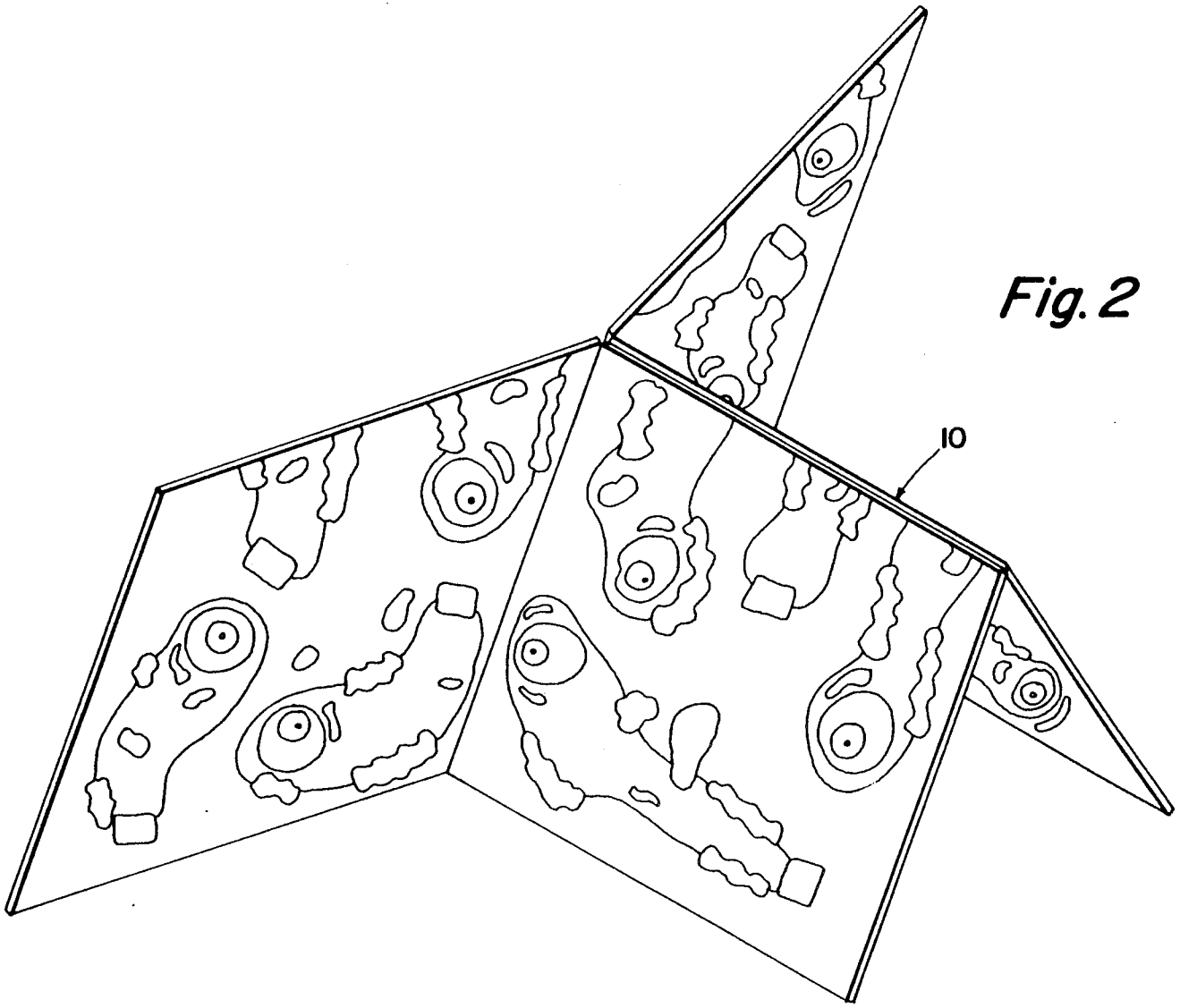

FIG. 2: is a view of the playing board composed of four sections adapted to be folded as indicated.

Figure 3:
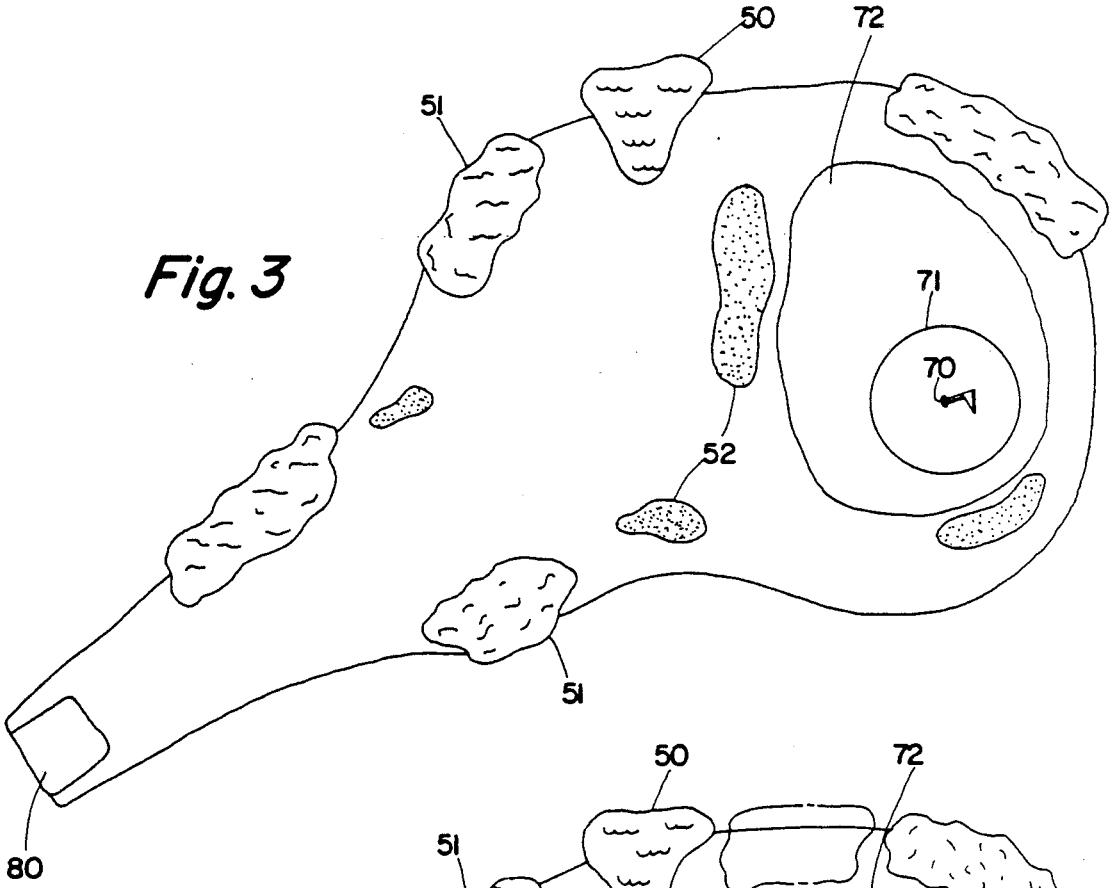
Figure 4:
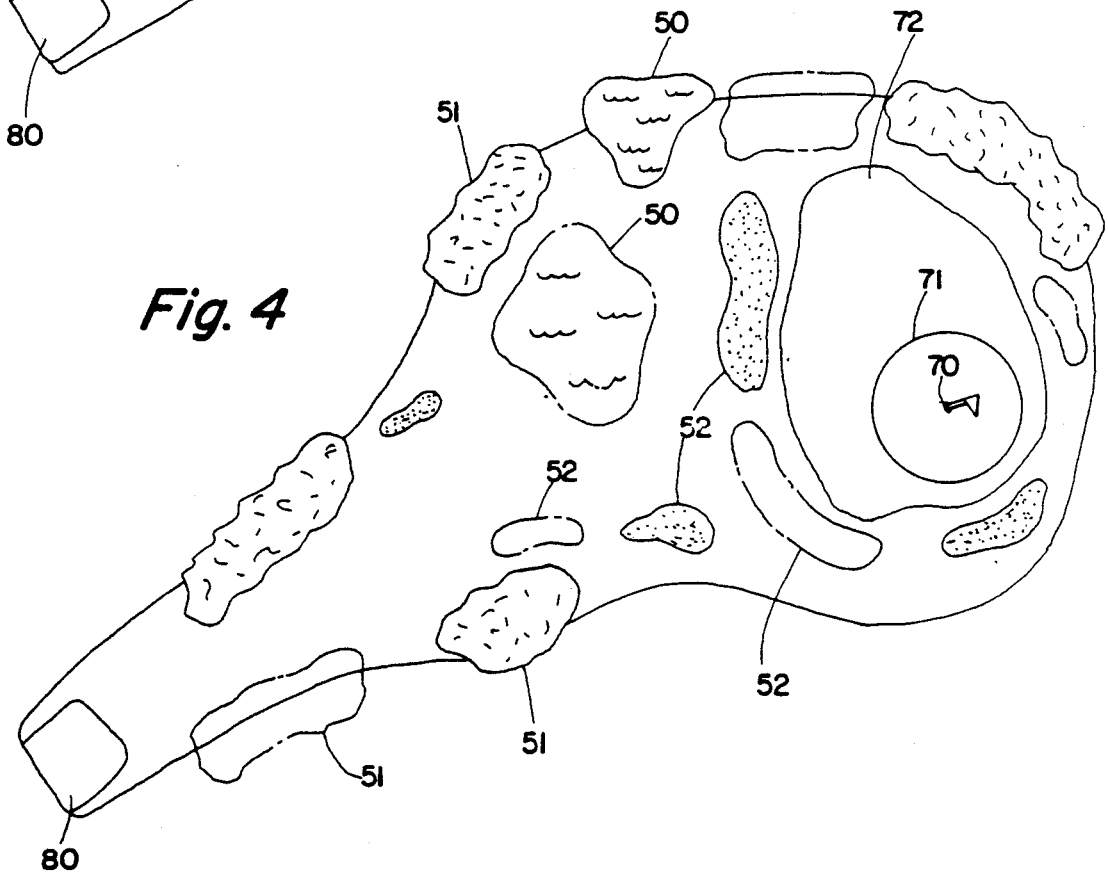
Figure 7:
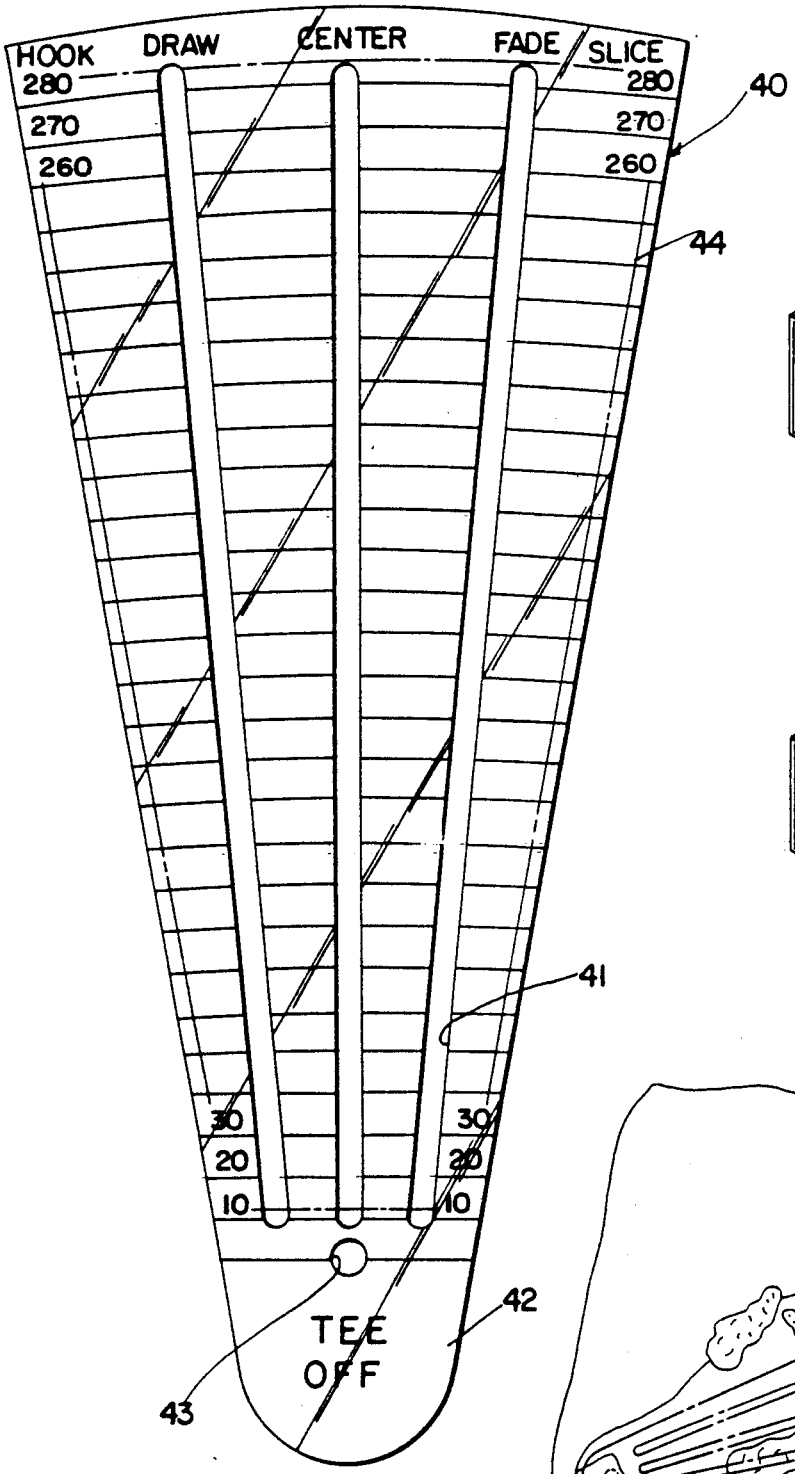
Figure 8:
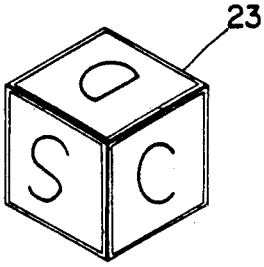
Figure 9:
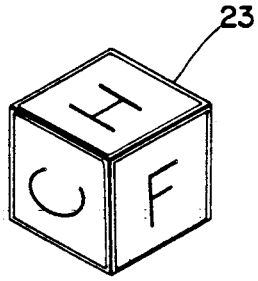
Figure 10:
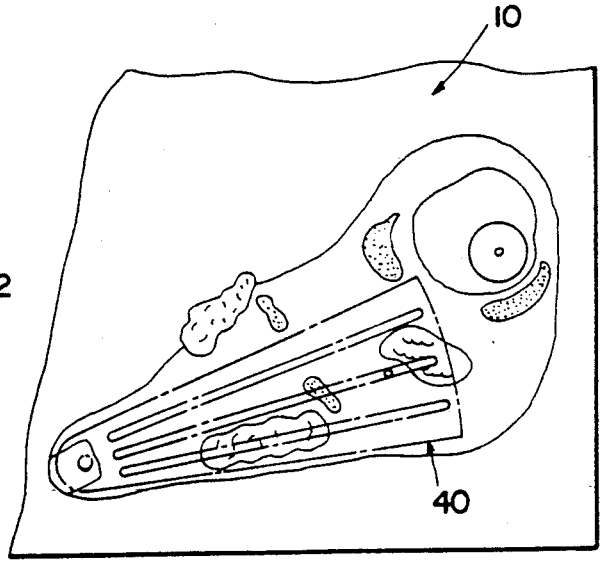
Figures 11, 12:
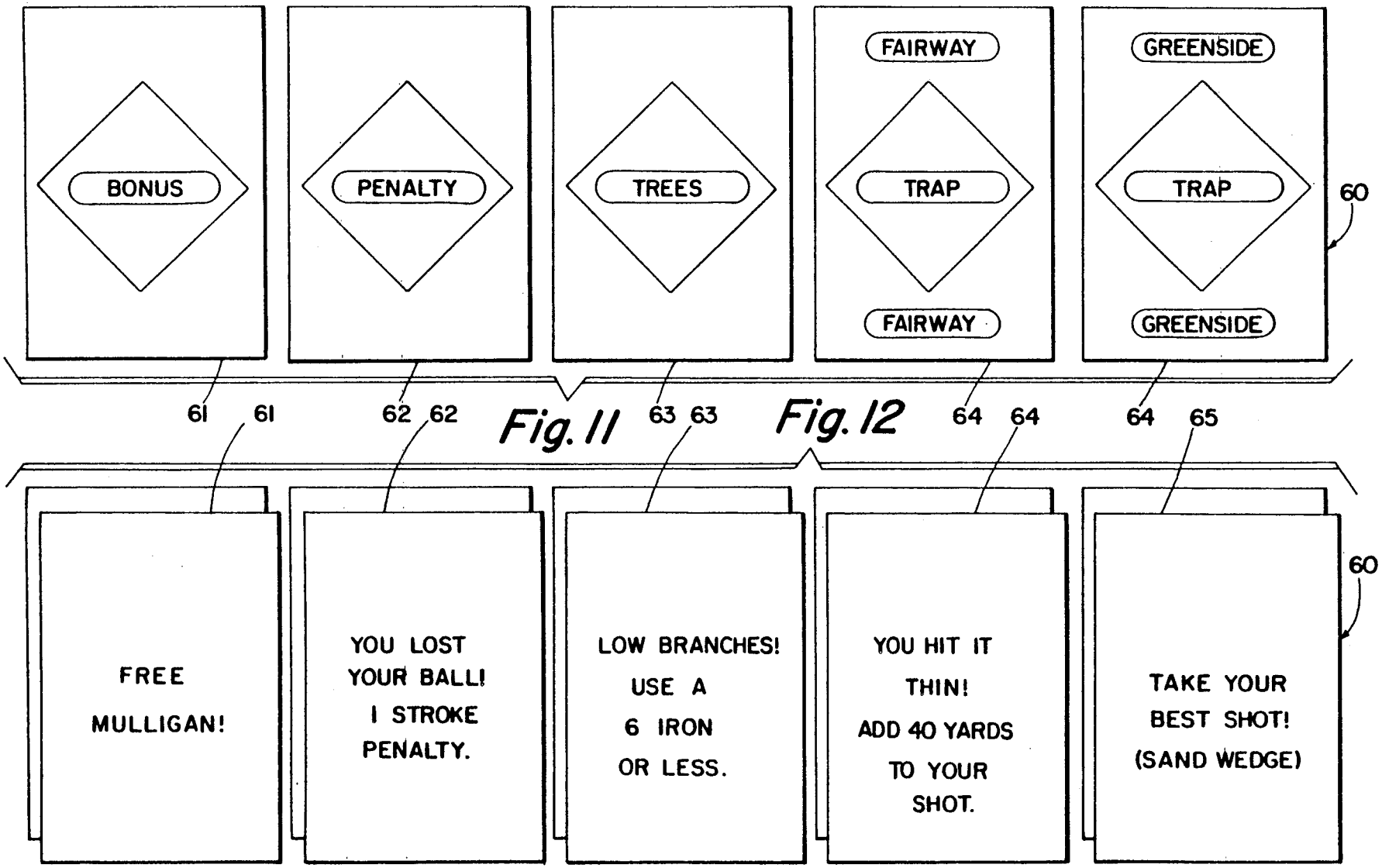

FIG. 3: is a view of a playing hole adapted to be employed on the playing board of FIGS. 1 and 2;

FIG. 4: is a view identical to FIG. 3, but which has added separate hazards placed thereon;

FIG. 5: is a representation of a shot schedule card;

FIG. 6: is a representation of an official score card;

FIG. 7: is a plan view of a distance direction gauge;

FIG. 8: is a view of a six-sided die showing the different sides thereof bearing markings for different shots, "S", "D", "C", "H", "F", FIG. 9: is a similar view to that of FIG. 8;

FIG. 10: is a view of a portion of a hole, the board showing a distance direction gauge placed thereon;

FIG. 11: is a view of sets of cards used in the game namely, "Bonus", "Penalty", "Trees", "Fairway Trap", "Greenside Trap" cards;

FIG. 12: is a view showing instructions carried on certain of the cards of FIG. 1 in said set of cards;

Referring now to the drawings in all of which like parts are indicated by like reference characters. It will be noted that a game board 10, containing the representation of the holes of a golf link is employed. In use three dice 20 are employed to ascertain the distance and direction of selected clubs. Two of the die 21, and 22 contain conventional die markings, the faces of the same bearing numbers from 1 to 6 inclusive, and the third die 23 has markings shown more clearly in FIGS. 8 and 9, corresponding to those carried on the distance direction gauge 40, of FIG. 7 namely, the first letter of each of the following words, "Hook", "Draw", "Center" "Slice", and "Fade", namely H D C and S and F, as shown in FIGS. 8 and 9. The conventional die are shown at 21 and 22 and the so-called third die at 23.

Note each hole contains a tee-box 80, as shown in FIGS. 3 and 4 and that the holes are preferably arranged on a laid-out board 10, as shown in FIG. 1. The board 10, as shown comprises four sections which are secured together and adapted to be spread out, as shown in FIG. 1. Nine holes are shown on each completely spread-out side of the board wherefor an eighteen hole course is provided. The sectional board 10 is adapted to be folded when not in use as shown in FIG. 2. Various means employed in the game as hereinafter described are shown in FIG. 1, viz. a direction indicating gauge 40, sets of cards 16, a rule book 15, a club selector reference card 30, a pack of score cards 31, die at 20, more particularly conventionally marked die 21 and 22 and a six-sided special marked die 23, the dice being more specifically described hereinafter. Ball marking pencils, as shown at 62 are also employed, the pencils having preferably eraseable characteristics and adapted to be used by each player for marking his position after each shot and for joining the same if desired. A cloth for erasure of such markings is shown at 63. At 50 additional hazards are shown on a sheet which are adapted to be separately attached and detached from the sheet and placed optionally in any described position on any hole or holes on the board, for example, water hazards 52, trees 51, traps 50. The course hence can be played as designed or modified by placing the movable hazards as desired thereby redesigning the course. As in a conventional game of golf played on any golf course the game may be played by one or more players. If more than one player is playing the order for teeing off the first hole may be determined in any manner chosen by the players or as suggested in the rules supplied with the game as, for example, by each player rolling one of the conventional die, and player having the lowest numbered roll playing first and the other players following in the order of the number which turns up in their roll. For subsequent holes, the tee-box player scoring the lowest on the previous hole may "Have honors" and tee off first as in conventional golf team play and the player farthest away from the hole on any subsequent shot then would shoot first. In play, each player using the club selector reference card 30 decides the distance he wishes his shot to travel and selects an appropriate club which clubs are set forth on the card 30 together with a designated ordinary distance which can be achieved by use of the selected club. Eleven clubs are shown on the card, namely, a driver, a 3-wood, 3-iron, 4-iron, 5-iron, 6-iron, 7-iron, 8-iron, 9-iron, pitching wedge and sand wedge. After announcing his selection of the club the player places the direction indicator 40 on the board aiming the same in the direction he wishes to hit the ball. It will be noted that the indicator 40 is generally fan-shaped and provided with a hole 43 in the tab end thereof which is adapted to be placed on the tee box or over the ball position made on the previous shot, if not shooting from the tee. The spaced body of the direction indicator 40 as shown in FIG. 7, has three slots 41 extending from the tab end to the leading edge of the fan, the center one of said slots is marked "Center", the slot spaced to the right of the same "Fade", and the slot spaced to the left of center is marked "Draw", the right outer edge 44 is marked "Slice", and the left outer edge 45 marked "Hook". The ideal direction is center.

All tee-shots are normally assumed to be aimed at the front pointer of the gauge unless the player first discloses he is aiming his shot a number of yards to the right or left of the direction marker. After declaring the club aloud, the player rolls all three dice. Failure to declare the club chosen before shooting (rolling the dice) results in a one stroke penalty and the driver can only be used off the tee. The dice 20 determines the distance and placement of the snot. The total rolled by the two conventional dice 21, 22 determines the distance based on the club selected and the directional third die 23 determines the direction of travel of the shot for example, "Hook", etc. and placement of the ball. Preferably each player uses a differently colored pencil 62 to mark the location of his shot and draws a line connecting his shots as played. Once on the green, the player no longer uses the directional die. The putting ring 71 encircles each hole as shown in FIGS. 3 and 4. The two conventionally numbered dice are rolled for putting. According to the game, if a player lands on the green hit outside the ring 71, he rolls both dice. He must roll six or higher to reach the ring. If he rolls doubles, six is credited with a one putt hole. Inside the ring he must roll three or higher using only one die to hole the putt. The number of times ne rolls before reaching the designated number required counts as the number of putts on the hole. Conventional rules of golf are employed in the game of this invention and it is to be understood that numerous and extensive departures may be made from the specific embodiments described and shown herein without however departing from the spirit of this invention and the scope of the appended claims.

What I claim is:

1. An indoor golf game apparatus comprising:

(a) a game board having a representation of a golf course showing various individual holes thereon with tees, fairways, greens and pins on said green and hazards;

(b) club selection reference means comprising a listing of different golf clubs and a listing of different distances associated with golf club, each group of distances having a different numeral for distinguishing each group;

(c) a direction indicating gauge comprising a tab end and a plurality of lines radiating at different angles from the tab end, each said line having a different indicia for distinguishing each line;

(d) a first chance means having indicia corresponding to the indicia distinguishing said lines for randomly selecting an indicia thereby determining the direction of the shots;

(e) a second chance means having numerical indicia corresponding to the numerical indicia distinguishing said groups of distances for randomly selecting a a numeral, thereby determining a group of distances, a specific distance being obtained by each fairway shot as determined by the club selected according to the club selector reference means.

2. The golf game apparatus as set forth in claim 1 wherein:

(a) the chance means employed include three dice, all of the dice being six-sided dice, and the second chance means comprises two of the same each having individual numbers one to six on the separate faces thereof and the first chance means comprises a third dice bearing letters ∓S", "H", "C", "F" "O", thereon determining the direction of a shot.

3. The golf game apparatus as set forth in claim 1 wherein:

(a) the direction indicating gauge is adapted to be placed on the board to indicate the direction a player wishes to play his strokes and the position on the board secured by the stroke as determined by the use of the first chance means.

4. The golf game apparatus as set forth in claim 1 wherein;

(a) the direction indicating gauge is provided with slots in lines radiating from the tab end to permit a player to mark the lie of his ball.

* * * * *